United States Patent [19]

Senoo

[11] 4,403,127

[45] Sep. 6, 1983

[54] TOGGLE SWITCH HAVING PRESSURE CONTACT

[75] Inventor: Yasutaka Senoo, Yokohama, Japan

[73] Assignee: New Ohto Co., Ltd., Yokohami, Japan

[21] Appl. No.: 371,227

[22] Filed: Apr. 23, 1982

[30] Foreign Application Priority Data

May 14, 1981 [JP] Japan ..... 56-73324
Feb. 1, 1982 [JP] Japan ..... 57-12665[U]
Feb. 1, 1982 [JP] Japan ..... 57-12666[U]

[51] Int. Cl.[3] ..... H01H 1/50; H01H 1/36

[52] U.S. Cl. ..... 200/260; 200/252; 200/164 R; 200/11 K; 200/339

[58] Field of Search ..... 200/153 H, 162, 243, 200/252, 260, 261, 335, 339, 6 R, 11 G, 11 J, 11 K, 16 D, 16 R, 238, 244, 254, 275, 264 R

[56] References Cited

U.S. PATENT DOCUMENTS

| | | | |
|---|---|---|---|
| 2,002,587 | 5/1935 | Sachs | 200/162 X |
| 2,747,166 | 5/1956 | Hoffarth | 200/275 X |
| 2,808,476 | 10/1957 | Elliott | 200/243 X |
| 3,978,298 | 8/1976 | Fukuda et al. | 200/6 R |
| 4,200,773 | 4/1980 | Komatsu et al. | 200/11 G X |

*Primary Examiner*—Stephen Marcus
*Assistant Examiner*—Ernest G. Cusick
*Attorney, Agent, or Firm*—Kenway & Jenney

[57] ABSTRACT

A switch comprises a movable conductive contact in the form of a curved plate having an arcuate cross section, and terminals having ends projecting into a cavity. The movable conductive contact is pressed into the cavity to cause an end of the contact to be resiliently held against and slidably supported on the ends of the terminals.

4 Claims, 11 Drawing Figures

FIG. 1
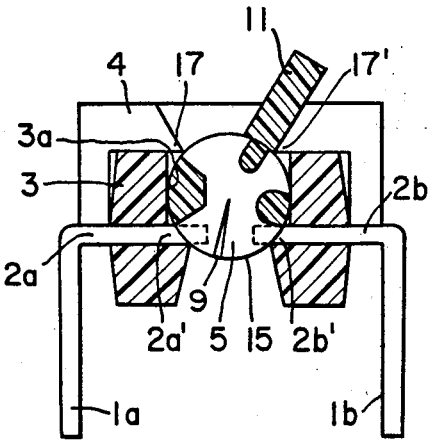
FIG. 2
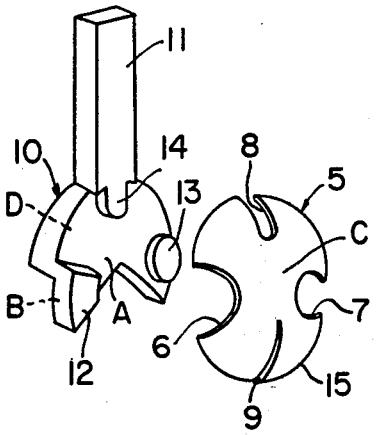
FIG. 4 (a)
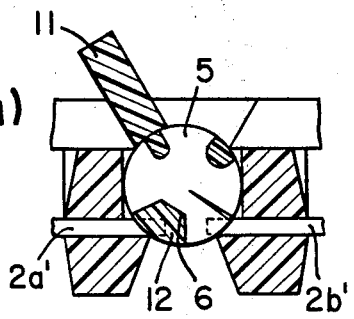
FIG. 3
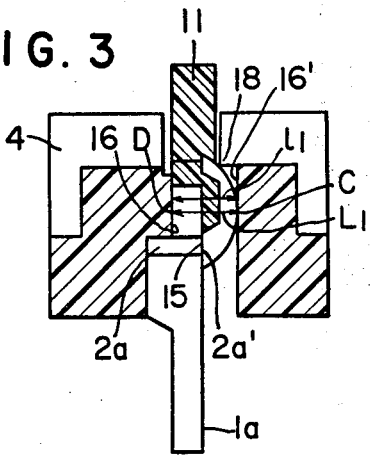
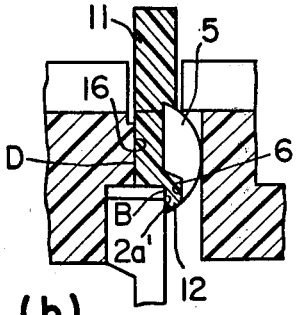
FIG. 4 (b)

TOGGLE SWITCH HAVING PRESSURE CONTACTBACKGROUND OF THE INVENTION

The present invention relates to a switch, and more particularly to a switch having a movable conductive contact held against the ends of terminals under increased pressure for switching operation.

There are various forms of mechanisms for switching on and off a current in a switch. One known mechanism is of a toggle construction having a conductive contact which is resiliently held against the end of one terminal and movable into contact with the end of the other terminal by a toggle rotatable about an intermediate ball member for making electrical connection between the terminals. The terminals can be electrically disconnected from each other when the contact is disengaged from the end of the other terminal upon release of pressure on the contact. The pressure with which the contact is held against the end of the other terminals is relatively weak with the use of such a toggle.

Another conventional structure is known as a sliding mechanism including a conductive contact which is normally urged downwardly as by a spring and held against one terminal end, the conductive contact being slidable laterally into contact with the other terminal end for electrical connection between the terminal ends. The electrical connection can be broken by sliding the contact out of contact with the other terminal end. The sliding mechanism can press the contact against the other terminal end with a relatively high pressure. However, there are structural limitations which prevent the application of a pressure large enough to sufficiently remove deposits from the contact or the terminal ends while the contact slides frictionally.

In order to prevent deposition of various forms of foreign matter such as dust and flux which could lose electrical conduction, it is necessary to enclose the switch in a shielded structure.

The metal surfaces of the terminal ends and contact tend to form non-conductive films thereon with time due to external environmental conditions, non-conductive films such as natural oxides formed by oxygen in the ambient air. Such non-conductive films can be broken by currents of medium magnitudes flowing through switches, and removed by frictional contact with the contact. However, the deposits cause malfunctions such as non-conduction in switches such as DIP switches which handle small currents on the order of microamperes. To avoid the formation of oxidized layers, vital portions of the terminal ends and contact have heretofore been plated with chemically stable precious metals such as rhodium and gold.

SUMMARY OF THE INVENTION

The above-described drawbacks in the prior art apparatus have been successfully eliminated by the present invention.

It is a major object of the present invention to provide a switch which can switch on and off a current stably and reliably.

Another object of the present invention is to provide a switch which is of a simple construction and can be manufactured with ease.

According to the present invention, a switch comprises an insulating base having a cavity, terminals supported on the insulating base and having ends projecting into the cavity, and a movable conductive contact in the form of a curved plate having an arcuate cross section, the movable conductive contact being pressed in the cavity and having an end resiliently held against and slidably supported on the ends of the terminals. With the arrangement of the present invention, the contact which is placed in the cavity is held against the terminal ends under pressure due to the shape of the contact itself without relying on any other urging means such as a spring. Thus, the contact is pressed against the terminal ends under increased pressure so as to withstand repeated switching operations. As the contact is held in biting engagement with the terminal ends, it renews contact surfaces when switching operation is repeated, for thereby reliably switching on and off currents stably for a long period of time. Contacting surfaces of the terminal ends and contact do not need to be plated with precious metal. The switch requires no shielding structure, and can bodily be washed in water. Since the switch is simple in construction, it can be fabricated less costly. The switch can find application to small-size switches such as DIP switches handling currents on the order of microamperes.

These and other objects of the invention will become apparent from the following description of embodiments thereof when taken together with the drawings.

BRIEF DESCRIPTION OF THE DRAWINGS

FIG. 1 is a transverse cross-sectional view of a switch according to an embodiment of the present invention;

FIG. 2 is a perspective view of a movable conductive contact and a slide plate on which the contact is mounted, for the switch shown in FIG. 1;

FIG. 3 is a longitudinal cross-sectional view of the switch illustrated in FIG. 1;

FIGS. 4(*a*) and 4(*b*) are transverse and longitudinal cross-sectional views of the switch of FIG. 1, respectively, showing the parts positions in which the switch is turned off;

DETAILED DESCRIPTION OF PREFERRED EMBODIMENTS

Figure 5A:
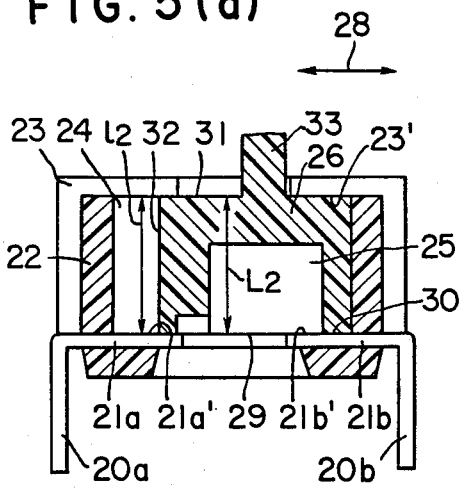
FIGS. 5(*a*) and 5(*b*) are transverse and longitudinal cross-sectional views, respectively, of a switch according to another embodiment of the invention.

As shown in FIG. 1, a switch according to an embodiment of the invention comprises an insulating base 3 supporting a pair of terminals 1*a*, 1*b* having ends 2*a*, 2*b* projecting into a cavity defined in the insulating base 3 and a cover 4 fitted over the insulating base 3, and a movable conductive contact 5 fitted in the cavity.

As shown in FIG. 2, the contact 5 is in the form of a part-spherical plate having in its peripheral marginal edge a recess 6 for breaking off a current flowing between the terminals 1*a*, 1*b*. The peripheral marginal edge of the contact 5 also has angularly spaced recesses 7, 8 serving to attach the contact 5 to the slide plate 10, and a slit 9 for adjusting the resilient force of the contact 5. The current-breaking recess 6 doubles as a recess for attaching the contact 5.

The contact 5 is formed by pressing a plate of a metal such as an alloy of copper and rhodium into a part-spherical plate. The peripheral marginal edge of the part-spherical plate is held in contact with sides 2a', 2b' of the terminal ends 2a, 2b. The peripheral marginal edge of the contact 5 bites into the sides 2a', 2b' for good electrical contact therewith. The peripheral edge may be cut into a knife edge for more reliable electrical contact.

The current-breaking recess 6 is positioned such that it opens toward a resin wall 3a of the insulating base 3 when a knob 11 of the switch is displaced to the right as shown in FIG. 1. When the knob 11 is moved leftward as shown in FIG. 4(a), the recess 6 is located at the side 2a' of the terminal end 2a. With the side 2a' positioned in the recess 6, the terminals 2a, 2b are electrically disconnected from each other.

The slide plate 10 illustrated in FIG. 2 serves to facilitate rotation of the contact 5. The slide plate 10 is made of synthetic resin and is in the form of a disc having a lower sectorial portion cut away. The knob 11 is mounted on the slide plate 10. The slide plate 10 has projections 12, 13 and 14 which can be received in the recesses 6, 7 and 8, respectively. The contact 5 is mounted on the slide plate 10 with the projections 12, 13 and 14 fitted respectively in the recesses 6, 7 and 8. The peripheral marginal edge of the contact 5 is held against a surface A of the slide plate 10. A lower peripheral edge 15 of the contact 5 projects downwardly of the slide plate 10 into abutment against the sides 2a', 2b' of the terminal ends. The projection 12 which fits in the current-breaking recess 6 has a rear surface B lying flush with the surface A of the slide plate 10. When the slide plate 10 is angularly moved, the rear surface B is brought into abutment against the side 2a' of the terminal end 2a.

As illustrated in FIG. 3, the contact 5 as mounted on the slide plate 10 is fitted in a gap or clearance defined between resin walls 16, 16' of the insulating base 3. Before the contact 5 is thus inserted in the gap, the distance $L_1$ between a crest C of the part-spherical surface of the contact 5 and a rear surface D (sliding surface) of the slide plate 10 is larger than the distance $l_1$ between the resin walls 16, 16'. Thus, the contact 5 and the slide plate 10 combined therewith is force-fitted into the gap. The contact 5 as pressed in the gap is rendered rotatable about the crest C with the lower peripheral edge 15 resiliently held against the sides 2a', 2b' of the terminal ends 2a, 2b. Upon angular movement of the slide plate 10, the contact 5 is turned about the crest C while being guided by edges 17, 17' (FIG. 1) and an edge 18 of the cover 4, during which time the peripheral marginal edge of the contact 5 is pressed against the sides 2a', 2b' as it rotates in a plane defined by the sides 2a', 2b'.

With the contact 5 as mounted on the slide plate 10 being thus press-fitted between the resin walls 16, 16', the peripheral edge 15 can be pressed against the sides 2a', 2b' of the terminal ends under increased pressure in biting engagement therewith for good electrical contact therebetween. The slit 9 in the contact 5 allows the peripheral edge 15 to be stably and uniformly held against the sides 2a', 2b' of the terminal ends under adjusted resilient forces even if the sides 2a', 2b' are staggered in position.

Operation of the switch thus constructed is as follows: When the knob 11 of the slide plate 10 is moved to the right as shown in FIG. 1, the contact 5 mounted on the slide plate 10 is angularly moved clockwise to bring the lower peripheral edge 15 into contact with the sides 2a', 2b' of the terminal ends 2a, 2b, whereupon the terminals 1a, 1b are electrically connected. Conversely, when the knob 11 is pushed to the left as illustrated in FIG. 4(a), the contact 5 is turned counterclockwise to cause the rear surface B of the projection 12 fitted in the recess 6 to be held against the side 2a'. Therefore, the terminals 1a, 1b are electrically disconnected from each other. Electrical connection or disconnection between the terminals 1a, 1b is effected in the manner described above. Since the peripheral edge 15 of the contact 5 is held in biting engagement with the sides 2a', 2b' under high pressure, good electrical connection is assured between the contact 5 and the sides 2a', 2b' even if the sides 2a', 2b' have thereon layers of flux, oxides, or other impurities which could otherwise obstruct such electrical connection.

Figure 5B:
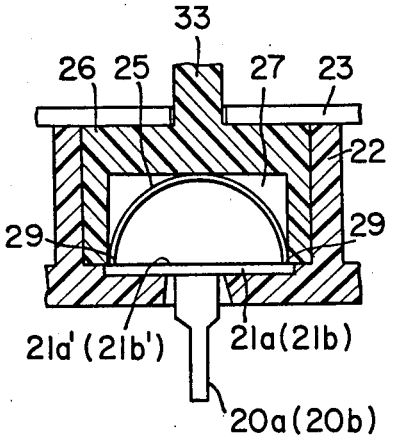

FIGS. 5(a) and 5(b) show a switch according to another embodiment. The switch has an insulating base 22 supporting thereon terminals 20a, 20b having ends 21a, 21b, respectively, which project into a cavity 24 defined jointly by the insulating base 22 and a cover 23 fitted over the insulating base 22, and a movable conductive contact 25 disposed in the cavity 24, the movable conductive contact 25 being in the form of an arcuate construction pressed from a rectangular conductive metal plate. The contact 25 is fitted in a recess 27 in a slide member 26, and oriented such that it looks arcuately when viewed in the direction of the arrowheads 28 along which the slide member 26 slides or the terminal ends are spaced from each other. The contact 25 has ends 29 held in abutment against upper surfaces 21a', 21b' of the ends 21a, 21b of the terminals 20a, 20b.

With the contact 25 mounted in the slide member 26, the ends 29 project beyond a lower end 30 of the slide member 26, and the distance $L_2$ between the ends 29 and an upper end 31 of the slide member 26 is larger than the vertical dimension $l_2$ of the cavity 24. The slide member 26 has a side 32 which is of a vertical length slightly smaller than the dimension $l_2$. When the contact 25 as disposed in the slide member 26 is force-fitted in the cavity 24, the ends 29 of the contact 25 are resiliently pressed against the upper surfaces 21a', 21b' of the terminal ends. When a knob 33 on the slide member 26 is slid in the direction of one of the arrowheads 28 at a time, the slide member 26 is guided by an inner surface 23' of the cover 23 so as to slide over the upper surfaces 21a', 21b' of the terminal ends.

Since the contact 25 is in the form of a resilient arcuate metal plate, the ends 29 thereof are held in biting engagement with the upper surfaces 21a', 21b' for good electrical connection. The ends 29 may be cut into the shape of a knife edge for better electrical connection.

Operation of the switch shown in FIGS. 5(a) and 5(b) will be described. In FIG. 5(a), the contact 25 is displaced out of contact with the upper surface 21a' of the end of the terminal 20a, the hence the terminals 20a, 20b are electrically disconnected from each other. When the knob 33 is slid to the left to move the contact 25 slidably leftward, the ends 29 of the contact 25 are brought over the upper surface 21a' of the terminal end 21a, whereupon the terminals 20a, 20b are electrically interconnected. With the arrangement shown in FIGS. 5(a) and 5(b), the ends 29 of the contact 25 are pressed strongly against the upper surfaces 21a', 21b' under high pressure in biting engagement therewith.

Figure 6A:
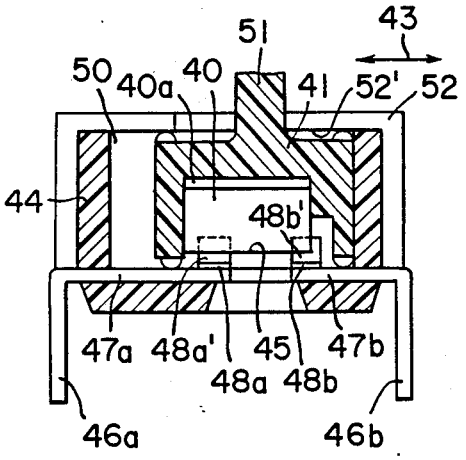
FIGS. 6(*a*) and 6(*b*) are transverse and longitudinal cross-sectional views, respectively, of a switch according to still another embodiment of the invention.
Figure 6B:
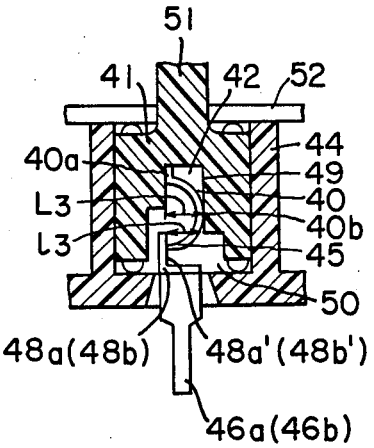

According to still another embodiment shown in FIGS. 6(a) and 6(b), a movable conductive contact 40 is formed from a rectangular conductive metal plate into an arcuate structure with an end portion 40a extending rectilinearly. The movable conductive contact 40 is fitted in a recess 42 in a slide member 41. The contact 40 is positioned such that it looks arcuately when viewed in the direction of the arrowheads 43 along which the slide member 41 is slidable or the terminal ends 21*a*, 21*b* are spaced from each other, the contact 40 being disposed on an insulating base 44. The contact 40 has an end 45 held in frictional contact with arms 48*a'*, 48*b'* of L-shaped contact members 48*a*, 48*b* mounted on ends 47*a*, 47*b*, respectively, of terminals 46*a*, 46*b* supported on the insulating base 44. The arms 48*a'*, 48*b'* extend into a cavity 50 in the insulating base 44.

With the contact 40 mounted in the slide member 41, the distance $L_3$ between an arcuate crest 40*b* of the contact 40 held against a resin wall 49 of the recess 42 in the slide member 41 and a distal edge of the end 45 of the contact 40 is larger than the distance $l_3$ between the resin wall 49 and the arms 48*a'*, 48*b'* of the contact members 48*a*, 48*b*. Therefore, the contact 40 as mounted in the slide member 41 and inserted forcibly between the arms 48*a'*, 48*b'* projecting into the cavity 50 and the resin wall 49, has its end 45 resiliently held against the arms 48*a'*, 48*b'*. When a knob 51 on the slide member 41 is slid in the direction of one of the arrowheads 43, the slide member 41 is guided by an inner surface 52' of a cover 52 so as to slide over the arms 48*a'*, 48*b'*.

Although the contact 40 is shown as being held against the arms 48*a'*, 48*b'* of the L-shaped contact members 48*a*, 48*b* mounted on the terminal ends 47*a'*, 47*b'*, the contact 40 may be held in frictional engagement directly with the terminal ends 47*a'*, 47*b'* which may be L-shaped in cross section.

In FIG. 6(*a*), the end 45 of the contact 40 is shown as contacting the arms 48*a'*, 48*b'* of the contact members 48*a*, 48*b*, and the terminals 46*a*, 46*b* are electrically connected to each other. When the knob 51 is displaced to slide the contact 40 to the left, the end 45 of the contact 40 is disengaged from one of the arms 48*b'*, whereupon the terminals 46*a*, 46*b* are electrically disconnected from each other.

Figure 7:
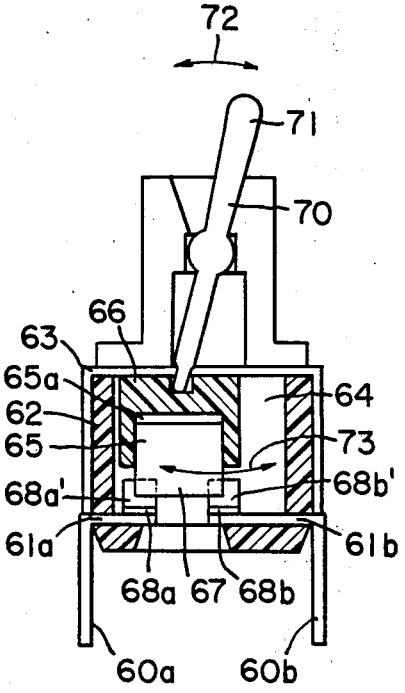
FIGS. 7(*a*) and 7(*b*) are transverse and longitudinal cross-sectional views, respectively, of a switch according to a still further embodiment of the invention.
Figure 7:
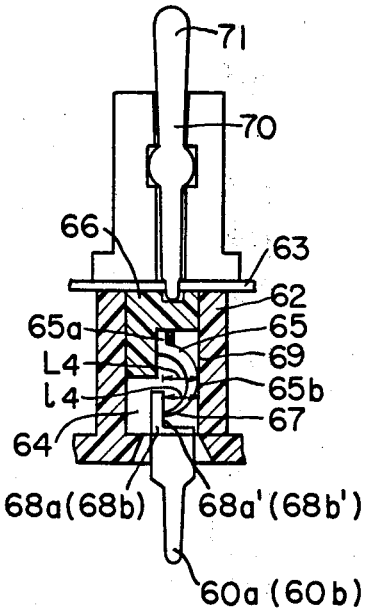

FIGS. 7(*a*) and 7(*b*) illustrate a switch according to a still further embodiment of the present invention. The switch of FIGS. 7(*a*) and 7(*b*) is basically of the same construction as that of the switch shown in FIGS. 6(*a*) and 6(*b*). The switch has an insulating base 62 supporting terminals 60*a*, 60*b* having ends 61*a*, 61*b*, a cover 63 fitted over the insulating base 62, and a contact 65 disposed in a cavity 64 defined jointly by the insulating base 62 and the cover 63. The contact 65 is formed from a rectangular conductive metal plate into an arcuate construction with a rectilinear end portion 65*a*, an arrangement similar to that shown in FIGS. 6(*a*) and 6(*b*). The contact 65 mounted on the insulating base 62 such that it looks arcuate when viewed in the direction along which a slide member 66 with the contact 65 mounted therein is slidable. The contact 65 has an end 67 held in frictional engagement with projecting arms 68*a'*, 68*b'* *of L-shaped contact members* 68*a*, 68*b* fixedly mounted on the ends 61*a*, 61*b* of the terminals 60*a*, 60*b*.

When the contact 65 is mounted in the slide member 66, the distance $L_4$ between an arcuate crest 69 of the contact 65 which is held against a resin wall 69 of the insulating base 62 and a distal edge of the end 67 of the contact 65 is larger than the distance $l_4$ between the resin wall 69 and the arms 68*a'*, 68*b'*. Therefore, the contact 65 as it is mounted in the slide member 66 and force-fitted between the resin wall 69 of the cavity 64 and the arms 68*a'*, 68*b'*, has its end 65 pressed resiliently against the arms 68*a'*, 68*b'*. Angular movement of a knob 71 of a toggle lever 70 engaging the slide member 66 in the directions of the arrowheads 72 causes the contact 65 to slide on the arms 68*a'*, 68*b'* in the directions of the arrowheads 73.

The end 67 of the contact 65 may be cut into the form of a knife edge for better electrical connection with the arms 68*a'*, 68*b'*. As with the switch shown in FIGS. 6(*a*) and 6(*b*), the terminal ends 61*a*, 61*b* may be cross-sectionally L-shaped and the contact 65 may be elongated in the longitudinal direction for direct frictional contact with the terminal ends 61*a*, 61*b*. Although in the illustrated embodiment the contact 65 is mounted in the slide member 66 and press-fitted between the resin wall 69 of the cavity 64 and the arms 68*a'*, 68*b'* for easily sliding movement, the slide member 66 may be dispensed with and the contact 65 may directly be inserted between the wall 69 and the arms 68*a'*, 68*b'*.

In the position of FIG. 7(*a*), the end 67 of the contact 65 is pressed in frictional contact with the arms 68*a'*, 68*b'* of the contact members 68*a*, 68*b*, and the terminals 60*a*, 60*b* are electrically connected to each other. When the knob 71 of the lever 70 is angularly moved counterclockwise, the end 67 of the contact 65 mounted in the slide member 66 is slidably turned counterclockwise in a plane defined jointly by the arms 68*a'*, 68*b'* until the end 67 is disengaged from one of the arms 68*a'*, whereupon the terminals 60*a*, 60*n* are electrically disconnected from each other.

Thus, there is provided in accordance with the invention a switch which has the advantages discussed above. The embodiments described are intended to be merely exemplary and those skilled in the art will be able to make variations and modifications in them without departing from the spirit and scope of the inventions. All such modifications and variations are contemplated as falling within the scope of the claims.

What is claimed is:

1. A switch comprising:

an insulating base having a cavity;

a plurality of terminals supported on said insulating base and having end portions projecting into said cavity; and a movable conductive contact in the form of a part-spherical plate having a current-breaking recess in a peripheral marginal edge thereof, said movable conductive contact being pressed in said cavity with said peripheral marginal edge being resiliently pressed against surfaces of said end portions; and of said terminals, said movable conductive contact being slidably angularly movable to angularly move said peripheral marginal edge in a plane defined jointly by said sides for displacing said current-breaking recess into or out of engagement with one of said sides for breaking or making electrical connection between said terminals.

2. A switch according to claim 1, including a slide plate of resin in the form of a disc having a sectorial notch in a lower side thereof, said movable conductive contact being mounted on said slide plate with said peripheral marginal edge being exposed through said sectorial recess for engagement with said ends of said terminals, said movable conductive contact and said slide plate being pressed together in said cavity.

3. A switch according to claim 1 or 2, wherein said peripheral marginal edge having a slit for adjusting the resilient force with which said peripheral marginal edge is pressed against said ends of said terminals.

4. A switch according to claim 3, wherein said peripheral marginal edge is in the form of a knife edge.

* * * * *